US008540547B2

(12) United States Patent
Ibarra

(10) Patent No.: US 8,540,547 B2
(45) Date of Patent: Sep. 24, 2013

(54) TOY WORKOVER RIG

(76) Inventor: Santiago Ibarra, Liberal, KS (US)

( * ) Notice: Subject to any disclaimer, the term of this patent is extended or adjusted under 35 U.S.C. 154(b) by 331 days.

(21) Appl. No.: 12/806,667

(22) Filed: Aug. 18, 2010

(65) Prior Publication Data

US 2012/0045964 A1 Feb. 23, 2012

(51) Int. Cl.
*A63H 17/12* (2006.01)
*A63H 17/00* (2006.01)

(52) U.S. Cl.
USPC ..... 446/426; 446/454

(58) Field of Classification Search
USPC ..... 446/424, 425, 426, 427, 428, 454, 446/456
See application file for complete search history.

(56) References Cited

U.S. PATENT DOCUMENTS

| | | | | |
|---|---|---|---|---|
| 2,551,036 | A | 5/1951 | Mills | |
| 2,846,813 | A | 8/1958 | Giardina | |
| 8,960,792 | | 11/1960 | Cyrus | |
| 3,061,313 | A * | 10/1962 | Greene | 273/139 |
| 3,292,301 | A | 12/1966 | Freeman | |
| 3,731,428 | A | 5/1973 | Glass et al. | |
| D252,229 | S | 6/1979 | Asano | |
| 4,531,654 | A | 7/1985 | Guyon | |
| 5,435,768 | A * | 7/1995 | Dunleavy | 446/427 |
| 6,264,528 | B1 * | 7/2001 | Doan et al. | 446/424 |

* cited by examiner

*Primary Examiner* — Kien Nguyen
(74) *Attorney, Agent, or Firm* — Oliver & Grimsley, LLC; Pamela Kayatta Riewerts, Esq.; Larry J. Guffey, Esq.

(57) ABSTRACT

A toy workover rig modeling the kind used to service oil and gas wells. The workover rig includes a wheeled truck. An extensible mast is pivotally fastened to the truck. A remotely-controlled pivoting assembly is connected to the truck for selectively moving the mast from a horizontal, traveling position to a vertical, substantially perpendicular operating position. A remotely-controlled telescoping assembly is connected to the truck for selectively extending the mast from a retracted position to an extended position. A remotely-controlled hoisting assembly is connected to the truck for lifted selected objects within the mast.

7 Claims, 8 Drawing Sheets

TOY WORKOVER RIG

FIELD OF THE INVENTION

The present invention relates generally to amusement devices having means to draw or pull.

BACKGROUND OF THE INVENTION

One common piece of heavy equipment used to produce hydrocarbons from the earth is referred to as: a workover rig, a completion rig, or a pulling unit. Such a thing can do many tasks, but it is primarily used to hoist damaged tubing from a well and lower undamaged tubing into a well so that oil and gas can flow more freely. A workover rig can also be used to "complete," repair, or swab a well to maximize its rate of fluid production.

A workover rig comprises a truck carrying a telescoping mast and a winch. In use, the truck is backed up to a well, the mast is raised, and the lifting of tubing is initiated using the winch. A typical, workover rig is used only during daylight hours. A workover rig cannot drill into the earth unless equipped with a special "power swivel" that moves up and down while turning drill pipe extending into the well.

Thousands of men in the United States work upon workover rigs and are interested in workover rigs. It is believed that many would like to own a functioning model of such a rig. Duplicating every feature of a workover rig in a mass-produced model, however, is not practical since many features would be tiny and especially costly to make. Changes are necessary in the various apparatus that: pivots the mast to its substantially perpendicular, upright orientation, telescopes the mast to its full length, and hoists tubing.

SUMMARY OF THE INVENTION

In light of the problems associated with replicating a full-size workover rig at a small scale, it is a principal object of the invention to provide a toy workover rig with means for pivoting, telescoping, and hoisting that are lifelike in operation if not exact in appearance.

It is another object of the invention to provide a toy workover rig of the type described that is radio controlled. A person with minimal experience can operate the toy workover rig without resort to prolonged training, study aids, or additional tools. An oil and gas operator can even employ my toy workover rig during a new hire's orientation session to provide a familiarity with a rig's working parts and function.

It is an object of the invention to provide improved elements and arrangements thereof in a toy workover rig for the purposes described which is lightweight in construction, inexpensive to make, and fully dependable in use.

The toy workover rig in accordance with this invention achieves the intended objects by featuring an extensible mast that is pivotally fastened to a wheeled truck. A remotely-controlled pivoting assembly is connected to the truck for selectively moving the mast from a horizontal, traveling position to a vertical, operating position. A remotely-controlled telescoping assembly is connected to the truck for selectively extending the mast from a retracted position to an extended position. A remotely-controlled hoisting assembly is connected to the truck for lifted selected objects within the mast.

The foregoing and other objects, features and advantages of my toy workover rig will become readily apparent upon further review of the following detailed description of the preferred embodiment illustrated in the accompanying drawings.

BRIEF DESCRIPTION OF THE DRAWINGS

My invention is more readily understood with reference to the accompanying drawings, in which.

Similar reference characters denote corresponding features consistently throughout the accompanying drawings.

DETAILED DESCRIPTION OF THE PREFERRED EMBODIMENT

Figure 1:
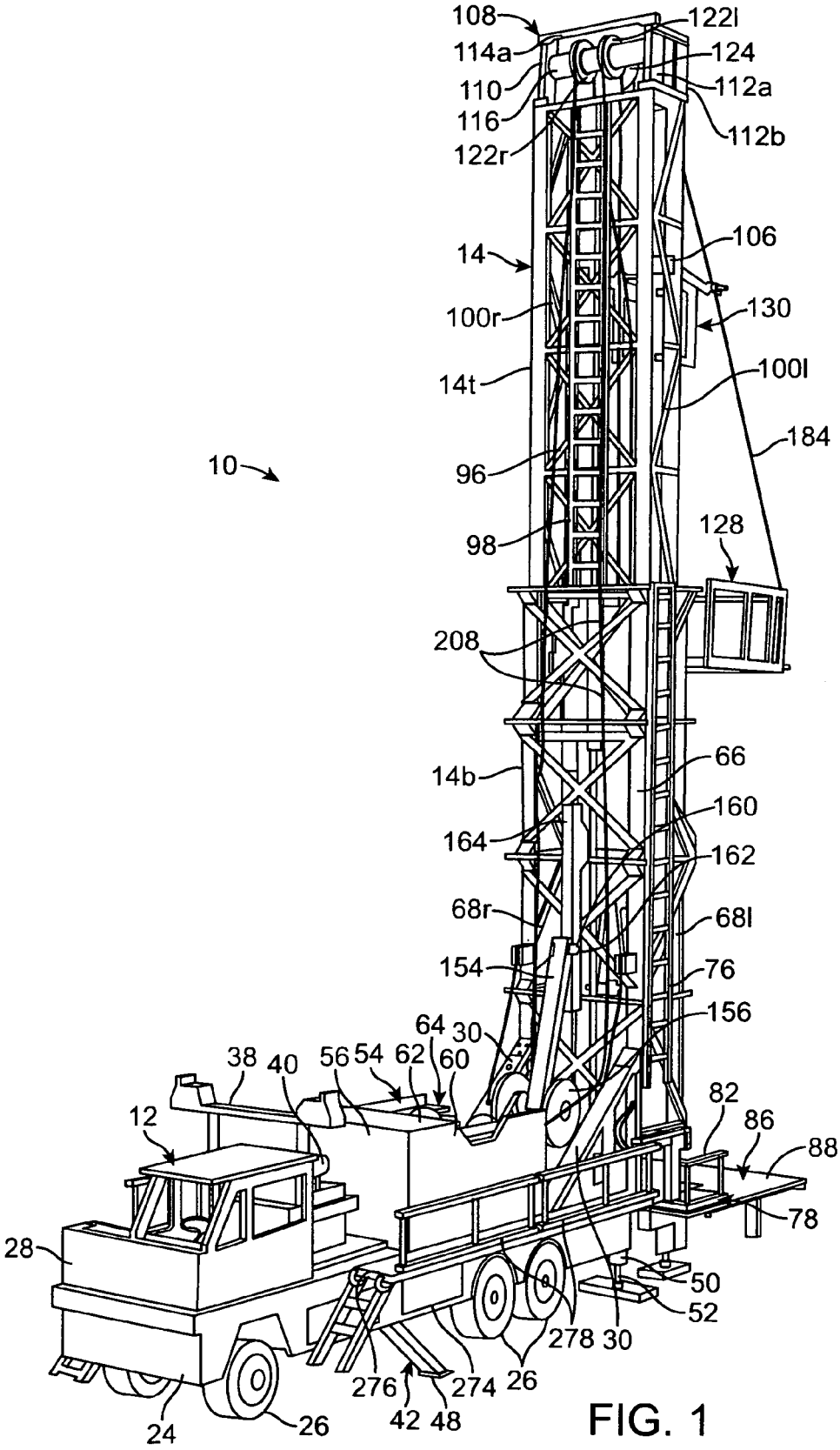
FIG. 1 is a perspective view of a toy workover rig having its mast elevated and telescoped upwardly.

Referring now to the FIGS., a toy workover rig in accordance with the present invention is shown at 10. Workover rig 10 includes a truck 12 that carries an extensible mast 14 at its rear. Mast 14 can be selectively moved from a horizontal, traveling position to a substantially perpendicular, vertical, operating position by a pivoting assembly 16. A telescoping assembly 18 is employed to selectively extend mast 14 to its full height. A hoisting assembly 20 selectively lifts a joint of tubing 22 within mast 14. Assemblies 16, 18 and 20 of the rig 10 are operated by remote control.

Truck 12 includes an elongated body 24 that is supported above the ground by a number of rotatable wheels 26. A cab 28 is affixed to the front of body 24. A pair of upright braces 30 is affixed to the rear of body 24 for pivotally securing mast 14 thereto. Each of braces 30 has a diagonal member 32 and a vertical member 34 being connected together so as to form an inverted V-shape. The tops of braces 30 are positioned at a height that is somewhat greater than that of cab 28 and carry hinges 36 to which mast 14 is pivotally connected. A mast support 38 is affixed to body 24 behind cab 28 for holding mast 14 above cab 28 when mast 14 is pivoted downward for safe movement of workover rig 10 from place to place. A dummy motor 40 is affixed to body 24 adjacent support 38.

Body 24 is provided with a number of ground-engaging stabilizers 42 and 44 to prevent it from tipping when mast 14 is pivoted substantially perpendicular upright and telescoped. A pair of center stabilizers 42 is provided at the midpoint of body 24 with one being located on each side of body 24. Each of stabilizers 42 has a guide sleeve 46 in the bottom of body 24 and an arm 48 that fits snugly, yet slidably, within sleeve 46. Each sleeve 46 is configured such that, when a moderate pushing or pulling force is applied to the associated arm 48, arm 48 is moved within sleeve 46 along an axis that extends downwardly and outwardly from body 24. When fully extended, each arm 48 contacts the ground at a point that is not beneath body 24 thereby preventing body 24 from tipping sideways. Additionally, a pair of rear stabilizers 44 is provided at the rear of body 24 with one being located on each side of body 24. Each stabilizer 44 has a vertically oriented, guide sleeve 50 in the bottom of body 24 that is internally, helically threaded. A helically threaded rod 52 is screwed into each sleeve 50. When screwed outwardly, each rod 52 is brought into contact with the ground beneath body 24 preventing body 24 from tipping rearwardly.

A draw works housing 54 is affixed to the top of body 24 between simulated motor 40 and braces 30. Housing 54 is a substantially rectangular box, being defined by: a front wall 56, a rear wall 58, a pair of opposed side walls 60, and a top wall 62. Top wall 62 is hingedly attached to front wall 56 for full access to the interior of housing 54 from above. The top of the rear wall 58 and the rear of the top wall 62 are provided with large openings as at 64 for access to components installed within housing 54 and described hereinbelow.

Housing 54 carries several joints of tubing 22 for lifting by rig 10. Two columns of hooks (not shown) are affixed to one of side walls 60 so that the hooks of each column have horizontally positioned counterparts in the other column. The columns are set at a distance apart that is somewhat less than the length of a joint of tubing 22. Removably positioned on each pair of horizontally spaced hooks is a joint of tubing 22.

Mast 14 includes a bottom section 14 *b* and a top section 14 *t* that are slidably connected together. Bottom section 14 *b* has a U-shaped cross section with a base truss 66 connecting together a pair of lateral trusses 68 *r* and 68 *l*. Each lateral truss 68 *r* and 681 has, extending along the length of its rear side, an inwardly facing, guide bar 70 that serves to slidably retain top section 14 *t* within the confines of bottom section 14 *b*. A tubing board rest 72 extends rearwardly from each guide bar 70 about midway along its length. Hinges 36 pivotally connect the bottom of base truss 66 to diagonal members 32.

A ladder 76 is affixed to, and extends along, truss 68 *l*. Beneath ladder 76, an operator's platform 78 is pivotally fastened to truss 68 *l*. Platform 78 has a pair of pegs 80 that carry a detachable handrail 82. Handrail 82 has a pair of pins 84 at its bottom that can be inserted into a pair of tight-fitting sockets (not shown) in the outer edge of platform 78. When mast 14 is pivoted substantially perpendicular upright, platform 78 is manually pivoted to a horizontal orientation and pins 84 are inserted into the sockets to hold the handrail 82 in a vertical orientation.

A work floor 86 is pivotally connected to bottom section 14 *b*. Work floor 86 comprises a U-shaped plate 88 having a pair of ground engaging legs 90 hingedly fastened thereto. One of a pair of hinges 92 pivotally connect the front of plate 88 to the bottom of lateral truss 681 and the other of hinges 92 pivotally connects the front of plate 88 to the bottom of lateral truss 68 *r*. A cutout (not shown) in the front of plate 88 between hinges 92 provides additional ground access for traveling block 94 and items carried thereby. When mast 14 is pivoted substantially perpendicular upright, plate 88 is manually pivoted to a horizontal orientation to the rear of mast 14 and legs 90 are pivoted downwardly to a vertical orientation to engage the ground and retain plate 88 in a horizontal orientation.

The top section 14 *t* of mast 14 has a U-shaped cross section being somewhat smaller than that of bottom section 14 *b* so that top section 14 *t* can slide easily therein. Top section 14 *t* has a base truss 96 adapted for slidable positioning against base truss 66. Base truss 96 carries a ladder 98 and connects together a pair of lateral trusses 100 *r* and 100 *l* adapted for slidable positioning against lateral trusses 68 *r* and 68 *l*. Each lateral truss 100 *r* and 100 *l* has a tubing board brace 102 affixed to, and extending rearwardly from, the bottom thereof. A pulley 104 is mounted atop each tubing board brace 102. Above each tubing board brace 102 and remote from pulley 104, a rod basket brace 106 is affixed to, and extends rearwardly from, each lateral truss 100 *r* and 100 *l*.

A crown 108, having a rectangular frame 110, is affixed to the top of top section 14 *t*. Frame 110 has a pair of side members 112 *a* and 112 *b* that serve as upward extensions of lateral trusses 100 *r* and 100 *l*. A pair of cross members 114 *a* and 114 *b*, positioned side-by-side, connect the tops of side members 112 *a* and 112 *b* together. A cylindrical shaft 116 connects side members 112 *a* together. A brace bar 118 connects side members 112 *b* together. A stub shaft 120 is affixed between shaft 116 and brace bar 118.

Crown 108 has a number of pulleys 122 *l*, 122 *r* and 124. A forward pair of pulleys 122 *l* and 122 *r* is rotatably secured upon shaft 116 in a side-by-side relationship. A medial pulley 124 is rotatably secured to stub shaft 120 and is positioned to rotate without interference from pulleys 122 *l* and 122 *r*. Pulleys 122 *l*, 122 *r* and 124 assist in the raising and lowering of traveling block 94.

A rearward pair of pulleys 104 is rotatably secured to brace bar 102 by a pair of support brackets 126. Pulleys 104 rotate independently of one another and assist in the raising and lowering of a tubing board 128 and rod basket 130 described hereinbelow.

Tubing board 128 is pivotally connected to top section 14 *t* and extends rearwardly from it. Tubing board 128 has a U-shaped retainer 132 that is pivotally connected at its front to tubing board braces 102. Affixed to the rear of retainer 132 are a number of forwardly facing tines 134 that define spaces therebetween for racking pieces of tubing 22 lifted by traveling block 94. One of a pair of handrails 136 is rigidly affixed to each of the opposite sides of retainer 132. For compact storage when mast 14 is pivoted downwardly onto mast support 38, another handrail 138 is pivotally secured at its bottom to the rear of retainer 132.

Rod basket 130 is pivotally connected to top section 14 *t* and extends rearwardly from it. Rod basket 130 has a U-shaped retainer 140 from which a basket member 142 is suspended by its U-shaped top rail 144. For compact storage, retainer 140 is pivotally connected at its front to rod basket braces 106 and the rear of top rail 144 is pivotally connected to the rear of retainer 140. (The front of retainer 140 is open and configured in a manner that prevents retainer 140 from pivoting to a position more than a few degrees beyond horizontal when mast 14 is pivoted to an upright, substantially perpendicular position.) Extending sideways from the front of top rail 144 is a pair of retaining pins 146 that abut the top of retainer 140 and maintain basket member 142 in an upright, substantially perpendicular position when the mast 14 is pivoted substantially perpendicular upright.

Pivoting assembly 16 operates to swing mast 14 substantially perpendicular upright on hinges 36. Pivoting assembly 16 includes an electric motor 148 mounted atop truck body 24 between braces 30. Motor 148 drives a gearbox 150 that effectively increases torque. Gearbox 150 has a horizontal driveshaft 152 that is rotated by motor 148.

Pivoting assembly 16 has a lever arm 154 that is affixed at its bottom end to driveshaft 152 and projects outwardly from driveshaft 152. Lever arm 154 is also affixed to the periphery of a gear 156 being part of gearbox 150. Thus, when the gear 156 and driveshaft 152 are caused to rotate by the operation of motor 148, lever arm 154 moves in concert with them.

A link 158 is affixed to the free end of lever arm 154 remote from drive shaft 152. Link 158 has a pair of lateral plates 160 that extend from lever arm 154. Link 158 also has a cross pin 162 that connects lateral plates 160 together at a location remote from lever arm 154.

Pivoting assembly 16 has a guide rail 164 affixed to base truss 66. Guide rail 164 extends along the length of base truss 66 and is positioned at its center. Guide rail 164 is approximately ⅓ the length of base truss 66 and is positioned midway between the ends of base truss 66. Guide rail 164 has a longitudinal slot 166 that extends from one of its ends to the other. Cross pin 162, carried at the free end of lever arm 154, is positioned within slot 166 where it freely slides.

Figure 2:
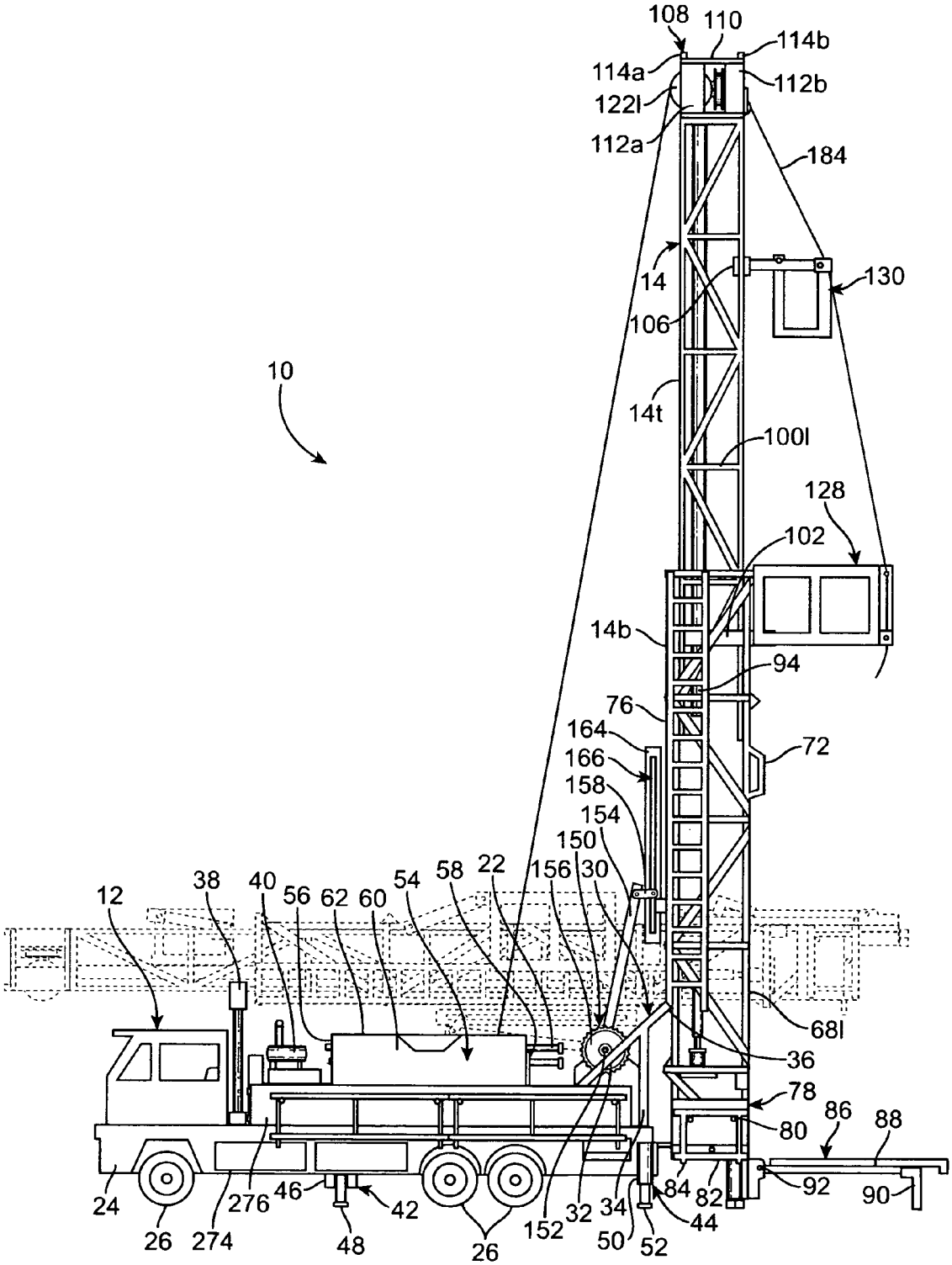
FIG. 2 is a side elevational view of the workover rig of FIG. 1 having its mast elevated and extended upwardly.

When motor 148 is energized to run in a "positive" direction, gear 156, driveshaft 152 and lever arm 154 are caused to rotate in a clockwise direction as seen in FIG. 2. Cross pin 162, then, presses against guide rail 164 from its position within slot 166 thereby pivoting mast 14 upwardly on hinges 36. The continued operation of motor 148 raises mast 14 to a vertical orientation with cross pin 162 pressing against guide rail 164 and sliding along the length of slot 166. Returning mast 14 to its starting position is a simple matter and is accomplished merely by reversing the polarity of the electrical current sent to motor 148. With motor 148 now running in a "negative" direction, gear 156, driveshaft 152, and lever arm 154 are rotated in a counterclockwise direction as seen in FIG. 2 thereby pivoting mast 14 downwardly.

Telescoping assembly 18 operates to lift top section 14 *t* above bottom section 14 *b* when mast 14 is swung to an upright orientation by pivoting assembly 16. Telescoping assembly 18 includes an electric motor 168 affixed to the bottom of bottom section 14 *b* between lateral trusses 68 *r* and 68 *l*. Motor 168 drives a gearbox 170, also affixed to the bottom of bottom section 14 *b*, having two meshing gears for transmitting power from the motor 168 to a driveshaft 172 extending upwardly from the gearbox 170.

Telescoping assembly 18 has a jackscrew 174. Jackscrew 174 is a helically threaded rod that extends the length of bottom section 14 *b*. The bottom of jackscrew 174 is affixed to the top of driveshaft 172 and rotates therewith.

Assembly 18 is completed with a jackscrew receiver 176. Receiver 176 has an elongated tube 178 that is positioned within top section 14 *t* for registration with jackscrew 174. Tube 178 extends the length of top section 14 *t* of mast 14. The top of tube 178 is affixed to the top of top section 14 *t* by a cross brace 180 extending between lateral trusses 100 *r* and 100 *l*. The bottom of tube 178 is positioned below tubing board braces 102. An internally threaded fitting 182 is firmly affixed to the bottom of tube 178. Into fitting 182, jackscrew 174 is selectively turned.

Figure 3:
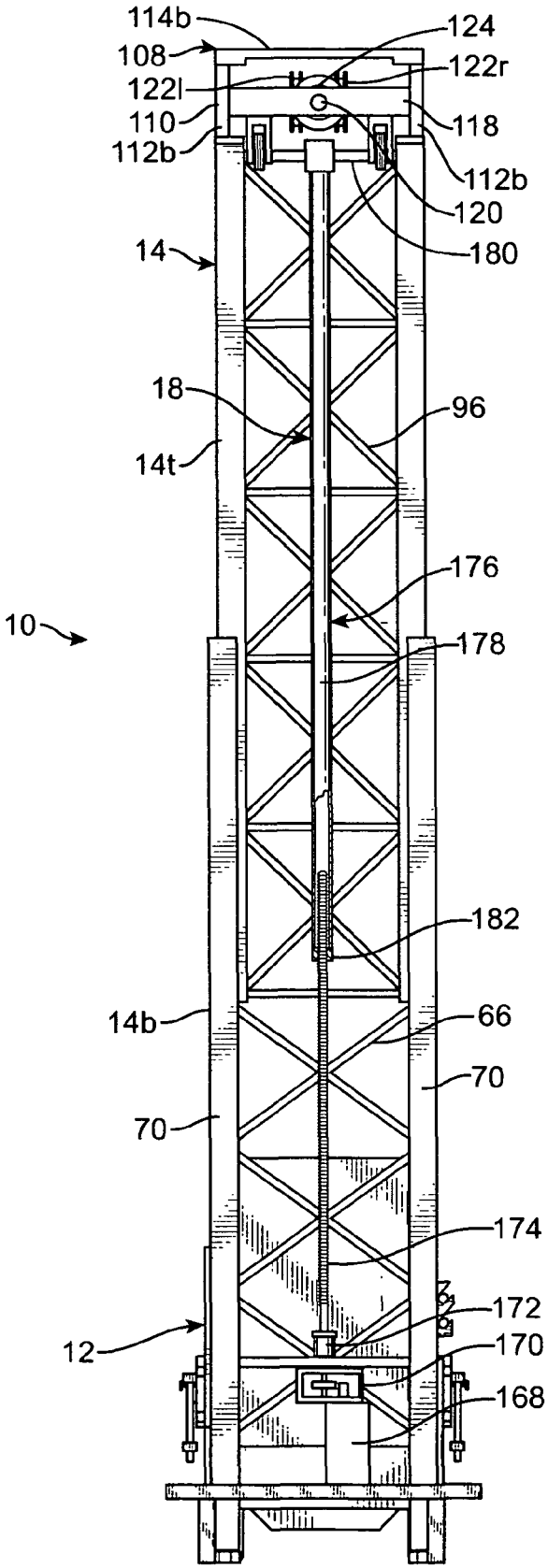
FIG. 3 is a rear elevational view of the workover rig with portions broken away to reveal details of the telescoping assembly.
Figure 4:
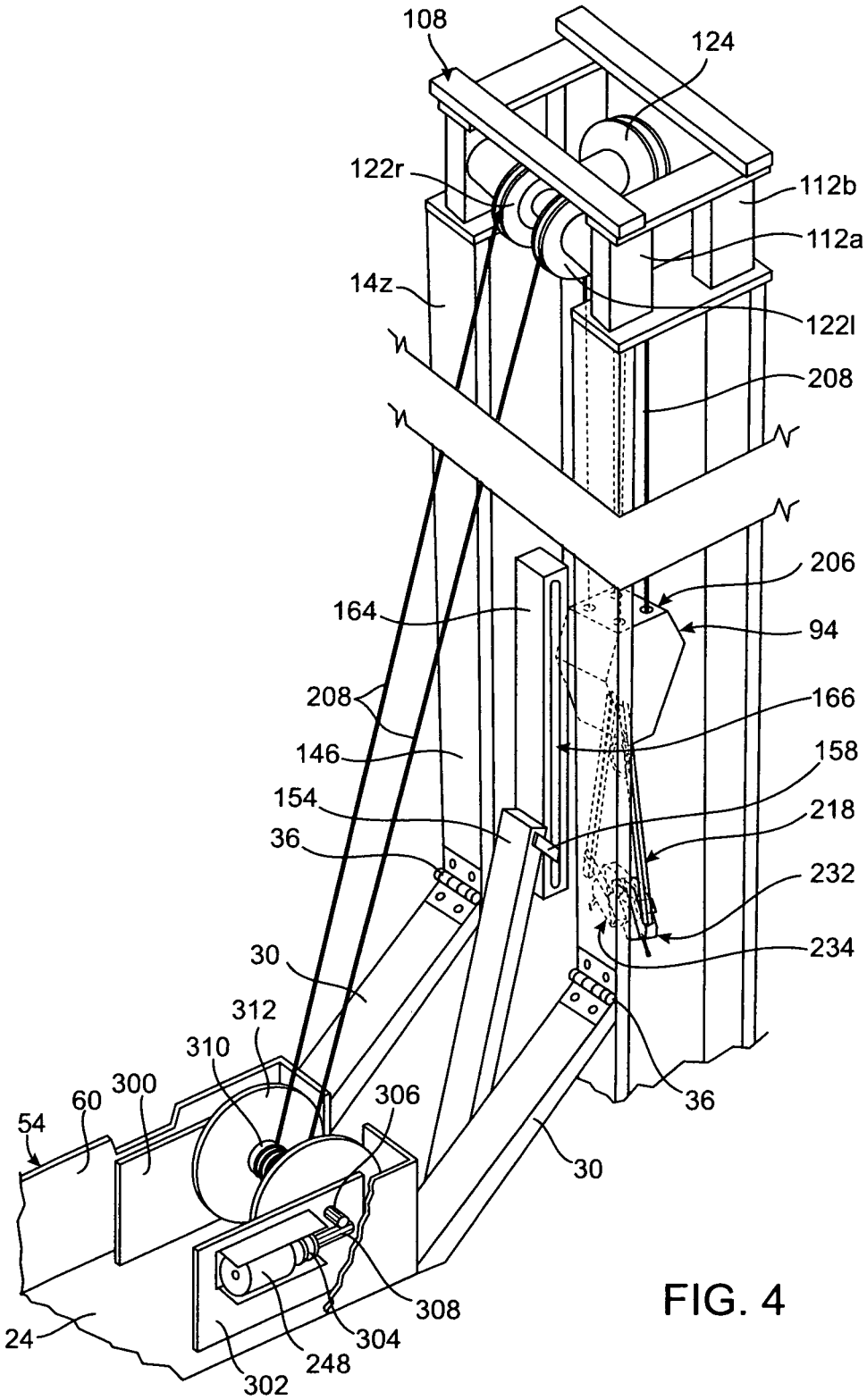
FIG. 4 is a perspective view of the rear portion of the workover rig with portions being broken away to reveal details of the hoisting assembly.
Figure 5:
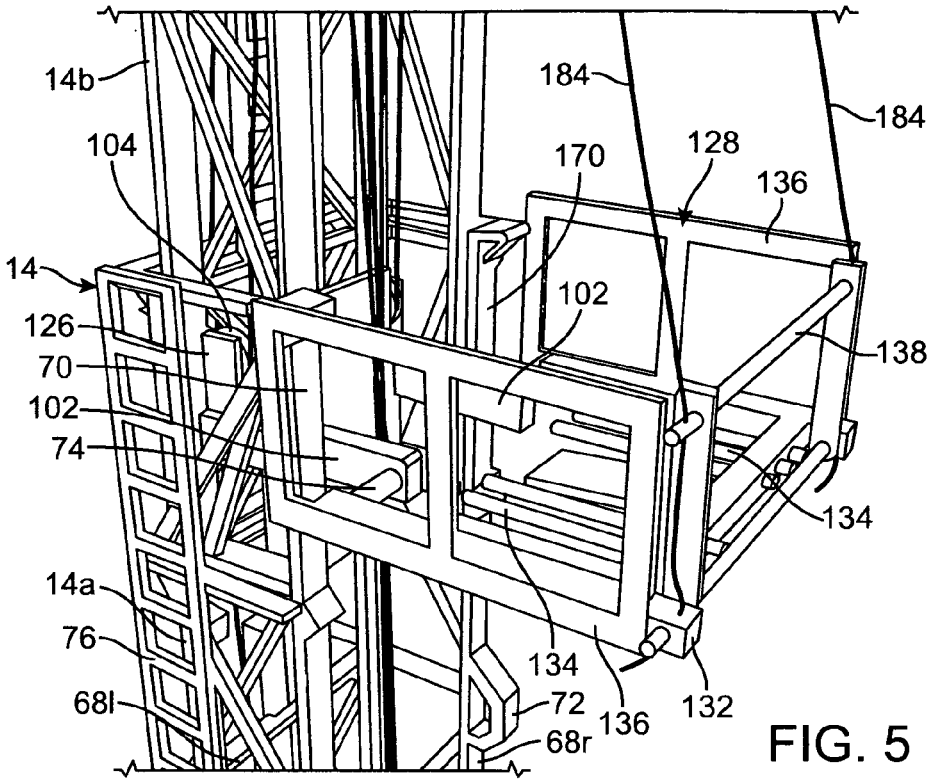
FIG. 5 is a perspective view of the central portion of the mast of the workover rig with the tubing board being shown in an extended position.
Figure 6:
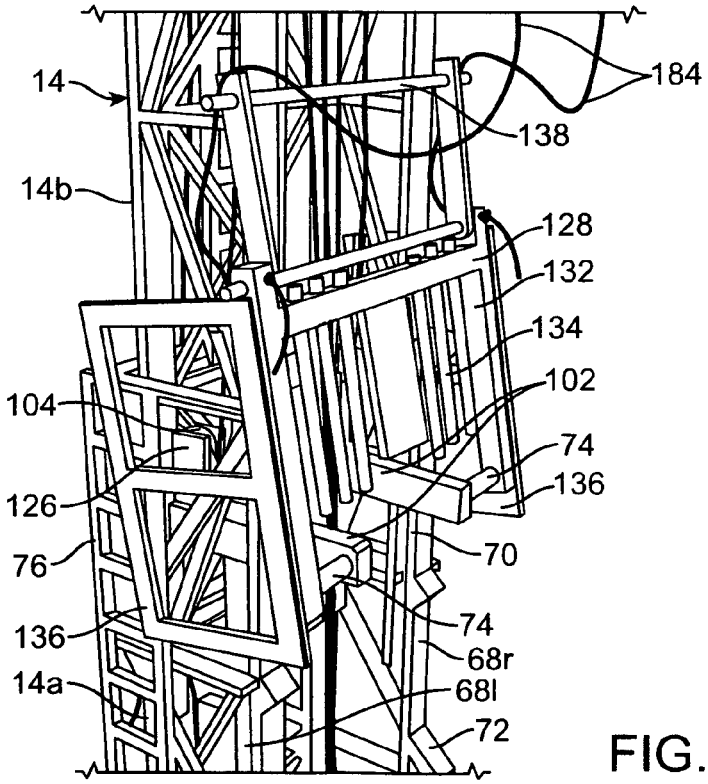
FIG. 6 is a perspective view of the central portion of the mast of the workover rig with the tubing board being shown in a retracted position.
Figure 7:
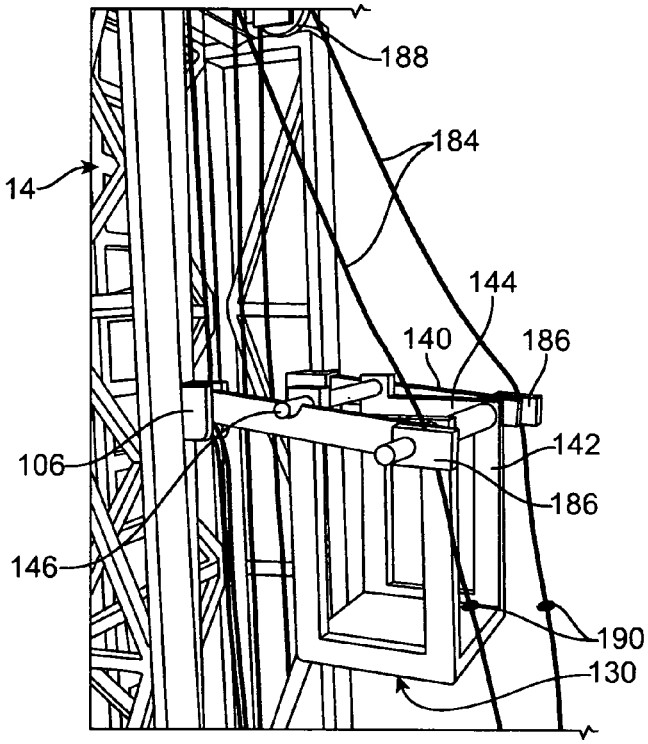
FIG. 7 is a perspective view of the upper portion of the mast of the workover rig with the rod basket being shown in an extended position.
Figure 8:
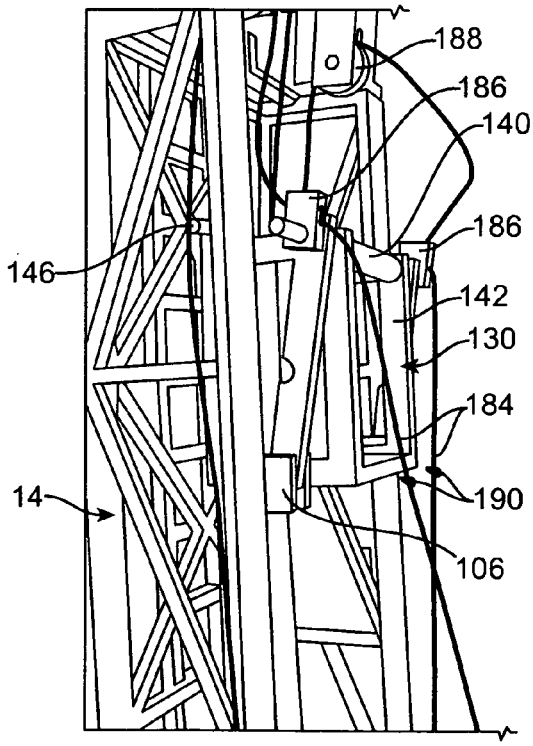
FIG. 8 is a perspective view of the central portion of the mast of the workover rig with the rod basket being shown in a retracted position.
Figure 9:
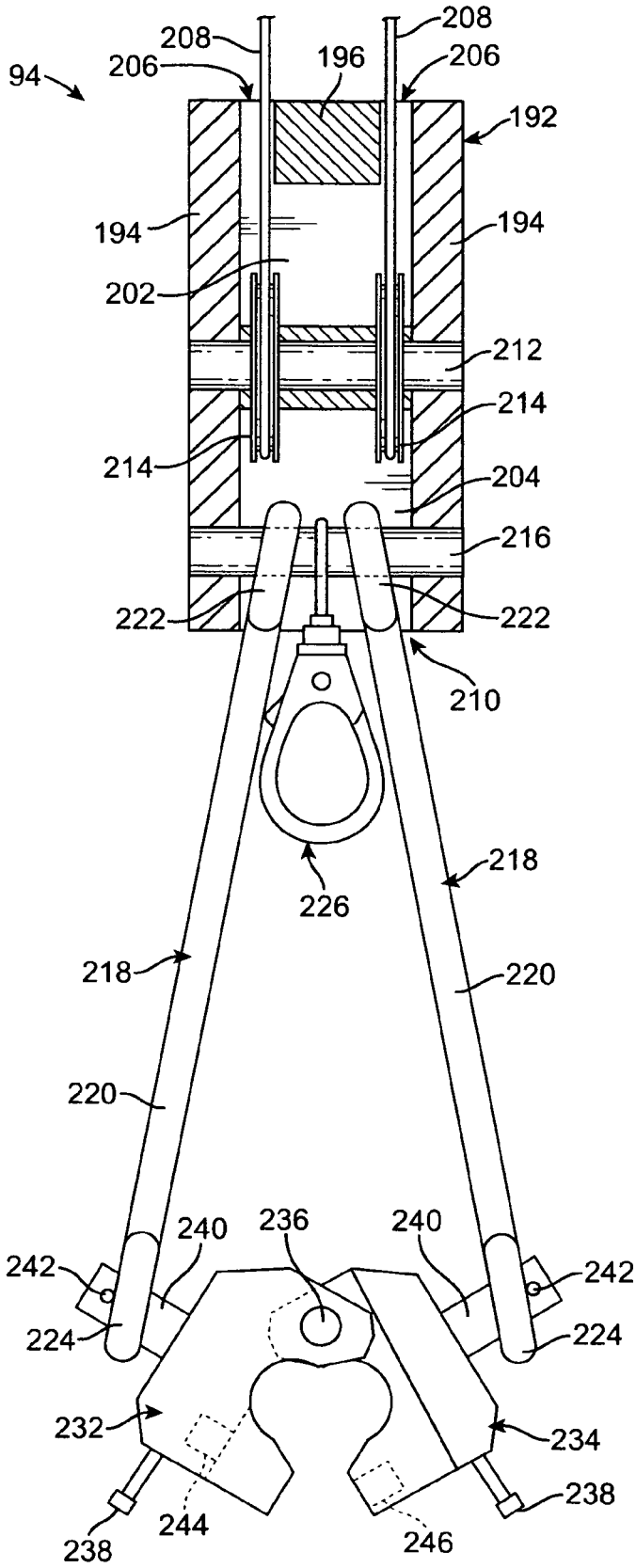
FIG. 9 is an enlarged front elevational view of the traveling block of the workover rig.
Figure 11:
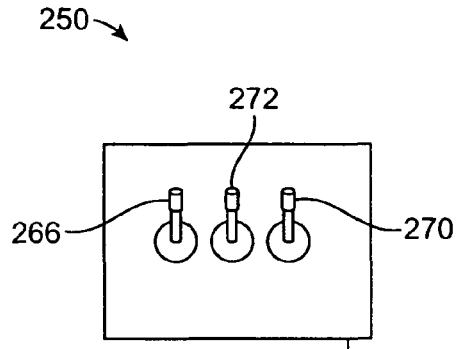
FIG. 11 is a schematic diagram of a transmitter of the workover rig featuring a three-channel remote control with joysticks.

When motor 168 is energized to run in a "positive" direction, driveshaft 172 and jackscrew 174 rotate counterclockwise when considered from above in FIG. 3. Fitting 182, being kept from rotating by tube 178, rides upwardly on jackscrew 174 imparting a lifting force through tube 178 and cross brace 180 to the top of mast 14. The continued operation of motor 168 elevates top section 14 *t* to it operating position above bottom section 14 *b*.

Returning top section 14 *t* to its starting position within bottom section 14 *b* is simple and is accomplished merely by reversing the polarity of the electrical current sent to motor 168. With motor 168 now running in a "negative" direction, driveshaft 172 and jackscrew 174 are rotated in a clockwise direction as seen from above in FIG. 3 thereby pulling fitting 182 and, hence, top section 14 *t* downwardly.

A user of workover rig 10 can easily distinguish when top section 14 *t* has reached the upper limit of its travel. The first and easiest way to make such a determination is to see that the top portions of trusses 66, 68 *r* and 68 *l* and the bottom portions of trusses 96, 100 *r* and 1001 line up horizontally. Another way involves an examination of tubing board 128 and rod basket 130. Their principle features should extend horizontally and vertically so that it is substantially perpendicular.

Tubing board 128 and rod basket 130 are tied to a pair of cords 184 that automatically extend them away from top section 14 *t* for use or retract them onto top section 14 *t* for storage and transport. Cords 184 extend from the top of bottom section 14 *b* through crown 108 and rod basket 130 to tubing board 128. Cords 184 have a length sufficient to hold tubing board 128 horizontal when top section 14 *t* is fully extended from bottom section 14 *b*. Cords 184 also have a length sufficient to hold tubing board 128 against top section 14 *t* with handrails overlapping and enclosing lateral trusses 68 *r* and 68 *l* when top section 14 *t* is retracted within bottom section 14 *b*.

Each of cords 184 touches tubing board 128 in two places. First, each of cords 184 is tied to the rear of retainer 132. Each of cords 184 extends upwardly from retainer 132 to the top of handrail 138 where it is also connected. Thus, when tubing board 128 is pivoted against top section 14 *t* when mast 14 is reduced in length, handrail 138 is pulled flat against top section 14 *t* and parallel with retainer 132.

Each of cords 184 contacts rod basket 130 at the rear of retainer 140 near its point of connection to basket 130. The cords 184 slide through socket members 186 on opposite sides of the retainer 140 in their passage from the top of handrail 138 to pulleys 188. A knot 190 is provided on each of the cords 184 between handrail 138 and socket member 186 so that, when cords 184 are pulled tight by moving top section 14 *t* into bottom section 14 *b*, knots 190 engage the bottom of retainer 140 to pull it flush against top section 14 *t*. Basket 130, being free to pivot relative to retainer 140, swings compactly into top section 14 *t* between lateral trusses 100 *r* and 1001 and against elongated tube 178.

Pulleys 188 on opposite sides of workover rig 10 receive cords 184. As shown, cords 184 run under pulleys 124 and over pulleys 188. Pulleys 124 and 188 prevent cords 184 from binding and tangling while top section 14 *t* is being extended or retracted from bottom section 14 *b*.

Hoisting assembly 20 includes a traveling block 94 having a housing 192 with a pair of hexagonal side walls 194 connected together by: a top wall 196, an upper front wall 198, a lower front wall 200, an upper back wall 202, and a lower back wall 204. Top wall 196 is provided with a number of openings 206 for the passage of a tubing line 208, formed from light rope, into and out of housing 192. Housing 192 has an opening 210 at its bottom.

An axle 212 connects the centers of side walls 194 together and is affixed at its opposite ends to side walls 194. Positioned in a spaced-apart relationship on axle 212 is a pair of pulleys 214 capable of independent rotation. As shown, tubing line 208 is extended into housing 192 through openings 206 and is wound around pulleys 214.

A bell hanger rod 216 is positioned in the opening 210 of housing 192 beneath axle 212. Rod 216 connects the bottoms of side walls 194 together. Rod 216 is affixed at its opposite ends to side walls 194.

Traveling block 94 has a pair of connecting rods or bells 218 suspended from it. Each of the bells 218 has a rod portion 220 at its center and an integral loop 222 affixed to the top of rod portion 220 and an integral loop 224 affixed to the bottom of rod portion 220. Each loop 222 is large enough for the free passage of rod 216 thereby permitting a large degree of pivoting and twisting motion of bells 218 on rod 216.

A hook 226 is suspended from rod 216 between bells 218. Hook 226 can be employed to catch and suspend miscellaneous tools used with rig 10. Optionally, hook 226 may incorporate a swivel mechanism 228 to permit it to rotate in any direction relative to rod 216.

From bells 218, an elevator 230 is suspended. Elevator 230 has a pair of C-shaped jaws 232 and 234 that are pivotally connected together by a pivot pin 236 to form a ring that can be selectively opened and closed to grasp a joint of tubing 22. To facilitate the opening and closing of the ring, a handle or horn 238 is affixed to each of jaws 232 and 234 remote from pivot pin 236. Between each horn 238 and the pivot pin 236, a hanger bar 240 is affixed to each jaw 232 and 234. Each bar 240 is configured to be extended through a bell loop 224 and is further configured at its outer end to receive a cotter pin 242 to prevent a bar 240 from being disengaged from a loop 224 once inserted therein. A magnet 244 is provided in the free end of jaw 232 and a piece of steel 246 is provided in jaw 234. When the free ends of jaws 232 and 234 are pivoted together, the attraction of the magnet 244 to the piece of steel 246 tends to keep jaws 232 and 234 closed. A light pull in opposite directions on horns 238, however, is sufficient to open jaws 232 and 234.

Hoisting assembly 20 operates to move traveling block 94 up and down within mast 14. To this end, assembly 20 includes a pair of mounting plates 300 and 302 affixed to truck body 24 within housing 54. Plates 300 and 302 are vertical, parallel to side walls 60, and spaced away from side walls 60. An electric motor 248 is affixed to plate 302 between plate 302 and the adjacent side wall 60. Motor 248 drives a gearbox 304 also affixed to plate 302. Gearbox 304 has two meshing gears 306 and 308 for the transmission of power. The large gear 306 is rotated by the small gear 308 to reduce the speed of the small gear 308 and proportionately increase the torque of the large gear 306. The large gear 306 is affixed to a driveshaft 310 that is journaled in plates 300 and 302 such that gear 306 and drive shaft 310 rotate together.

Hoisting assembly 20 has a spool 312 that is affixed to drive shaft 310 and that rotates with driveshaft 310. Upon spool 312 is wound the opposite ends of the tubing line 208. Selectively energizing motor 248 so as to cause drive shaft 310 to rotate in a "positive" direction causes the two ends of the tubing line 208 to be unwound from spool 312. Energizing motor 248 so as to cause driveshaft 310 to rotate in a "negative" direction causes the two ends of tubing line 208 to be wound onto the spool 312.

The tubing line 208 has a midpoint that is positioned atop pulley 124 in crown 108. From there, the opposite ends of line 314 extend down and away from the pulley 124 to traveling block 94. The ends of line enter block 94 through openings 206 and extend under a respective one of the pulleys 214. From pulleys 214, the ends of line 208 extend upward to a respective one of the pulleys 122 *r* and 122 *l*. The ends of line 208, then, pass over pulleys 122 *r* and 122 *l* and down to spool 312. It should be appreciated that when line 208 is unwound from the spool 312, traveling block 94 is lowered in mast 14. When line 208 is wound onto the spool 312, the block 94 is elevated in the mast 14.

The operation of workover rig 10 is by three-channel, remote control. A transmitter 250 broadcasts electrical operations signals to a receiver 252 carried within truck body 24 to activate one of a number of servos 254, 256 and 258 also carried within truck body 24. Activating servos 254, 256 and 258 closes dual-throw switches 260, 262, or 264 to selectively operate motors 148, 168 and 248 to move mast 14 or traveling block 94.

Figure 10:
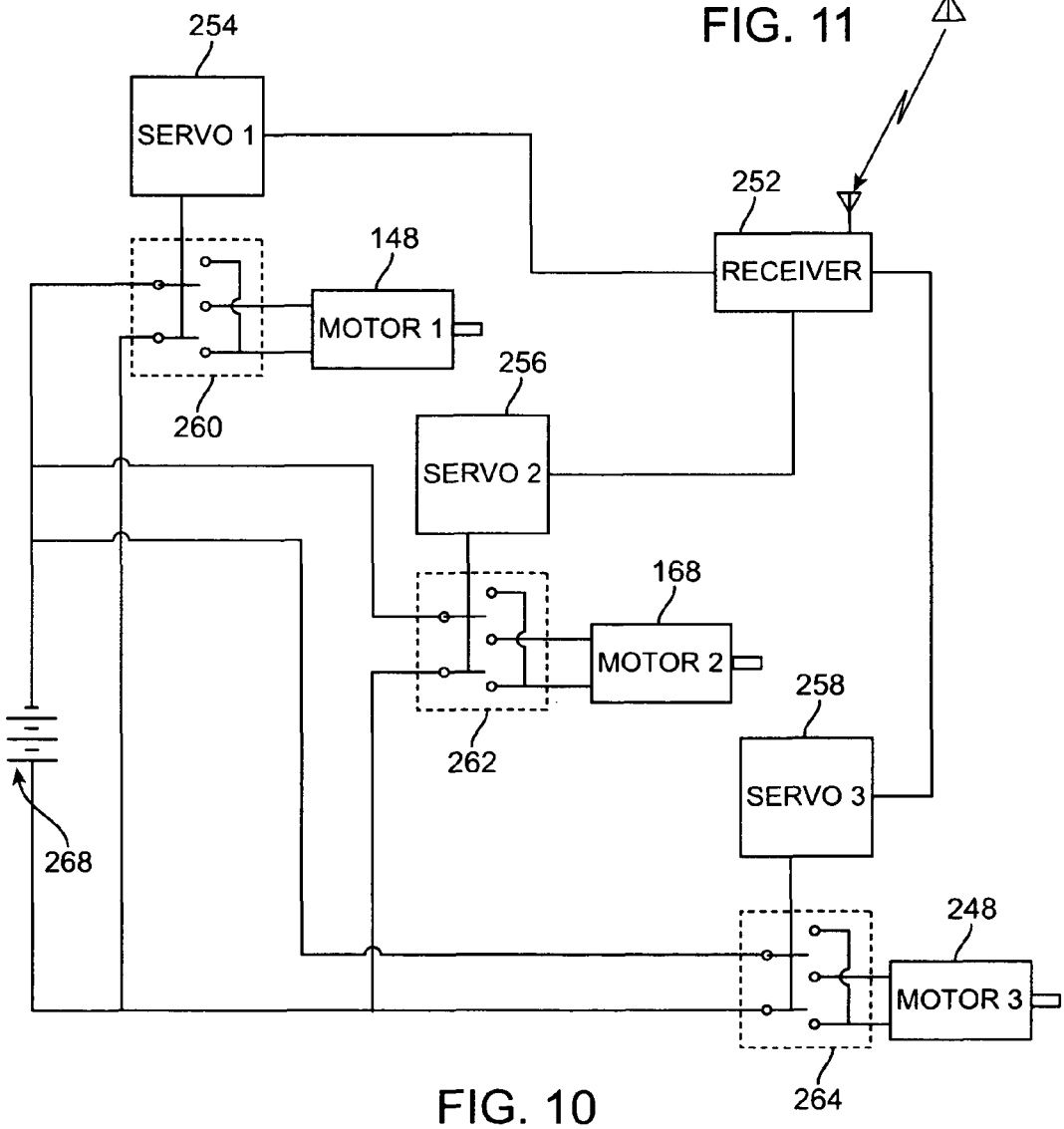
FIG. 10 is a schematic diagram of the electrical circuit for the workover rig.

A joystick 266 on transmitter 250 controls the operation of the pivoting assembly 16. By moving a joystick 266 to the "up" position, an electrical operations signal is broadcast from transmitter 250 to receiver 252 carried within truck body 24. When such a signal is received, receiver 252 produces an electrical activation signal that activates servo 254 to move dual-throw switch 260 from its normally open position to a closed position in a "positive" sense, say, toward the top of FIG. 10. The closed switch 260 connects motor 148 to a battery 268 carried in truck body 24 in a way that causes lever arm 154 and mast 14 to rise from its initial horizontal position shown in broken lines in FIG. 2. Maintaining switch 260 in the closed position described permits mast 14 to rise to a vertical orientation with truck body 24 serving as a stop to further pivoting movement.

Joystick 266 can be manually moved by a user to the "down" position to broadcast another electrical operations signal from transmitter 250 to receiver 252. When this signal is received, receiver 252 produces an electrical activation signal that activates servo 254 to move switch 260 from its normally open position to a closed position in a "negative" sense, say, toward the bottom of FIG. 10. The closed switch 260 connects motor 148 to battery 268 in a way that provides electrical current to motor 148 in a direction that is opposite to that described in the previous paragraph so that motor 148 moves lever arm 154 and mast 14 downward toward support 38. Support 38 serves as a stop to the continued downward pivoting of mast 14.

Joystick 266 is spring-biased to a neutral position. In a neutral position, transmitter 250 broadcasts no electrical operations signal to receiver 252 and receiver 252 returns switch 260 to an open condition. So, when a user releases joystick 266, motor 148 is deenergized to hold mast 14 at a chosen orientation: up, down, or somewhere in between.

When mast 14 is fully pivoted to an upright position, substantially perpendicular work floor 86 is manually pivoted away from bottom section 14 *b*. Then, with work floor 86 in a horizontal orientation, legs 78 are pivoted downwardly and engaged with the ground. Afterward, when play with rig 10 is complete, work floor 86 is returned to its original position against bottom section 14 *b* and mast 14 is pivoted down upon support 38.

Joystick 270 on transmitter 250 controls the operation of the telescoping assembly 18. By moving a joystick 270 to the "up" position, another electrical operations signal is broadcast from transmitter 270 to receiver 252. When this particular signal is received, receiver 252 produces an electrical activation signal that activates servo 256 to move dual-throw switch 262 from its normally open position to a closed position in a "positive" sense, toward the top of FIG. 10. The closed switch 262 connects motor 168 to battery 268 in a way that causes jackscrew 174 to rotate and drive top section 14 *t* upwardly from bottom section 14 *b*. Maintaining switch 262 in the closed position, by holding joystick "up," fully elevates top section 14 *t*.

When top section 14 *t* rises from bottom section 14 *b*, tubing board 128 and rod basket 130 are automatically deployed from mast 14. The upward movement of top section 14 *t* puts slack in line—and permits tubing board 128 and rod basket 130 to fall away from top section 14 *t*. Of course, the retraction of top section 14 *t* into bottom section 14 *b* puts line—under sufficient tension to pivot tubing board 128 and rod basket 130 upwardly into a retracted position in top section 14 *t*.

Joystick 270 is moved by a user to the "down" position to broadcast another electrical operations signal from transmitter 250 to receiver 252. When this signal is received, receiver 252 generates an electrical activation signal that activates servo 256 to move switch 262 from its normally open position to a closed position in a "negative" sense, i.e., toward the bottom of FIG. 10. The closed switch 262 connects motor 168 to battery 268 in a way that provides electrical current to motor 168 to move top section 14 *t* downwardly into bottom section 14 *b*.

Joystick 270 is spring-biased to a neutral position. In a neutral position, transmitter 250 broadcasts no electrical operations signal to receiver 252, and receiver 252 returns switch 262 to an open condition. So, when a user releases joystick 270, motor 168 is deenergized to hold top section 14 *t* at a chosen position relative to bottom section 14 *b*.

Joystick 272 on transmitter 250 controls the operation of the hoisting assembly 20. By moving a joystick 272 to the "up" position, an electrical operations signal is broadcast from transmitter 250 to receiver 252. When this signal is received, receiver 252 produces an electrical activation signal that activates servo 258 to move dual-throw switch 264 from its normally open position to a closed position in a "positive" sense and toward the top of FIG. 10. The closed switch 264 connects motor 248 to battery 268 in a way that causes spool 312 to wind up tubing line 208 thereby elevating traveling block 94. Maintaining switch 264 in the closed position, by holding joystick 272 "up," raises traveling block 94 into crown 108.

Joystick 272 is moved by a user to the "down" position to broadcast another electrical operations signal from transmitter 250 to receiver 252. When this signal is received, receiver 252 generates an electrical activation signal that activates servo 258 to move switch 264 from its normally open position to a closed position in a "negative" sense, i.e., toward the bottom of FIG. 10. The closed switch 264 connects motor 248 to battery 268 in a way that provides electrical current to motor 248 to move traveling block 94 downwardly toward work floor 86.

Joystick 272 is spring-biased to a neutral position. In a neutral position, transmitter 250 broadcasts no electrical operations signal to receiver 252, and receiver 252 returns switch 264 to an open condition. So, when a user releases joystick 272, motor 248 is deenergized to hold traveling block 94 at a chosen position between the top and the bottom of mast 14.

With traveling block 94 being positioned near work floor 86, a user can simulate the running of tubing from a wellbore. To do this, the jaws 232 and 234 of elevator 230 are first opened, a tubing segment 22 is positioned therein, and jaws 232 and 234 are closed. Next, the elevator 230 is moved above the tubing board 128 by moving the traveling block 94 with appropriate movements of joystick 272. Now, tubing 22 is moved laterally to a suitable space between tines 134 and, by pushing horns 238 apart, jaws 232 and 234 are reopened to release tubing 22 into the tubing board 128. Finally, traveling block 94 is lowered back to the work floor 86 to repeat the process. The process can be repeated to provide limitless fun.

When play with rig 10 is complete, mast 14 can be returned to a compact state like that found on a real workover rig that is being driven over the road. Rig 10 is most easily stored in this condition. Others may prefer to keep mast 14 in an upright, substantially perpendicular and fully extended condition. In this manner, rig 10 makes a great display model and focal point wherever set up.

While workover rig 10 has been described above with a high degree of particularity, it will be appreciated by those skilled in making toys that modifications can be made to it. For example, wheels 26 beneath cab 28 can be made to turn via remote control to steer truck 12 and a remotely controlled motor (not shown) can be added to drive a set of wheels 26 and propel truck 12 over the ground. (Such things are, of course, commonly found in r/c cars.) Also, downwardly pivoting toolbox doors 274, sidewalks 276 and movable ladders 278 can provide added realism. So, it is to be understood that my invention is not limited solely to workover rig 10, but encompasses any and all workover rigs within the scope of the following claims.

I claim:

1. A toy workover rig, comprising:

a wheeled truck having a body including a front and rear end and a midpoint therebetween, and a set of lateral opposing sides;

an extensible mast having a top truss and bottom truss, said bottom truss being pivotally fastened to said truck;

a set of extendible ground-engaging stabilizers connected at points proximate said truck midpoint and rear ends, and having a configuration adapted to prevent said truck from tipping when an extensible mast is pivoted upright and telescoped, wherein, said stabilizers include guide sleeves and arms, wherein, said set of stabilizers provided at the midpoint of body are center stabilizers having a configuration adapted to extend beyond said lateral opposing sides of said body;

a remotely-controlled pivoting assembly being connected to said truck for selectively moving said mast from a horizontal, traveling position to a substantially perpendicular, operating position;

a remotely-controlled telescoping assembly being connected to said truck for selectively extending said mast from a retracted position to an extended substantially perpendicular position; and, a remotely-controlled hoisting assembly being connected to said truck for lifted selected objects within said mast.

2. The toy workover rig recited in claim 1, further comprising:

a tubing board pivotally connected to said top truss and having a configuration adapted to extend rearwardly from said top truss.

3. The toy workover rig recited in claim 2, further comprising:

a rod basket being pivotally connected to said top truss and having a configuration to extend rearwardly from said top truss.

4. The toy workover rig recited in claim 3, further comprising:

a work floor being pivotally connected to said bottom truss and including a plate having a pair of ground engaging legs hingedly fastened thereto.

5. The toy workover rig recited in claim 2, further comprising:

a work floor being pivotally connected to said bottom truss and including a plate having a pair of ground engaging legs hingedly fastened thereto.

6. The toy workover rig recited in claim 1, further comprising:

a rod basket being pivotally connected to said top truss and having a configuration to extend rearwardly from said top truss.

7. The toy workover rig recited in claim 1, further comprising:

a work floor being pivotally connected to said bottom truss and including a plate having a pair of ground engaging legs hingedly fastened thereto.

* * * * *